United States Patent [19]

Shigemura et al.

[11] Patent Number: 4,671,643

[45] Date of Patent: Jun. 9, 1987

[54] CONTROLLING METHOD OF A COPYING MACHINE

[75] Inventors: Yutaka Shigemura, Takarazuka; Yoshinori Makiura, Tondabayashi; Mitsuya Ishito, Sakai, all of Japan

[73] Assignee: Mita Industrial Co. Ltd., Osaka, Japan

[21] Appl. No.: 716,431

[22] Filed: Mar. 27, 1985

[30] Foreign Application Priority Data

Mar. 30, 1984 [JP] Japan ..... 59-64984

[51] Int. Cl.[4] ..... G03G 13/20; G03G 15/20

[52] U.S. Cl. ..... 355/3 FU; 219/216; 355/14 FU

[58] Field of Search ..... 355/3 FU, 14 FU; 219/216, 388, 469

[56] References Cited

U.S. PATENT DOCUMENTS

| | | | |
|---|---|---|---|
| 3,926,519 | 12/1975 | Rebres | 219/216 X |
| 4,318,612 | 3/1982 | Brannan et.al. | 355/14 FU |
| 4,385,826 | 5/1983 | Itol | 355/14 FU |
| 4,512,649 | 4/1985 | Derimiggio | 355/14 FU X |

*Primary Examiner*—Fred L. Braun

*Attorney, Agent, or Firm*—Beveridge, DeGrandi & Weilacher

[57] ABSTRACT

A method for controlling a copying machine having a copying cycle and fusing device. The fusing device is formed of a rotatable heating roller and a press roller in mutually forcible contact with the heating roller, which fuses a toner image on a copying paper at a fusing temperature upon passage through the rollers. The heating roller is heated to a first temperature above the fusing temperature. The copying cycle is delayed during a first interval of time after the heating roller reaches the first temperature. The copying cycle is set to a wait-reset state after the first time interval. The heating roller is cooled to a second temperature below the fusing temperature and the copying cycle is set to a wait state. The heating roller is heated from the second temperature to the fusing temperature during a second interval of time. The copying cycle is restored to the wait-reset state during the second time interval before the heating roller reaches the fusing temperature. The copying cycle is restored to the wait-reset state before a leading edge of the copying paper reaches the fusing device. In addition, the fusing device is at the fusing temperature when the leading edge passes between the rollers.

2 Claims, 6 Drawing Figures

CONTROLLING METHOD OF A COPYING MACHINE

BACKGROUND OF THE INVENTION

The present invention relates to a controlling method of a copying machine, more particularly, to a method for controlling the copying machine by the temperatures of a fusing device keeping it in a wait-reset state which is capable of the copying operation and in a wait state for preheating which is incapable of the copying operation.

In the copying machine of a type which heats and fuses a toner image transferred on the copying paper by the fusing device, should the copying operation be performed before the fusing device reaches a temperature high enough to fuse the toner, the toner image transferred specially on the copying paper will not be fused and the toner image will be readily damaged by hands, fingers and the like. The copying processing section, the conveying the copying paper section and so on are kept in a condition not to perform work as far as the temperature of the fusing device is still low. And the concrete measures to be taken are:

(1) Detecting that the fusing device has reached a preset temperature for fusing, a measure is taken for restoring the copying machine into the wait-reset state which enables to operates the copying operation section as well as the conveying the copying papers section and so on by detecting the signal, and (2) a measure for restoring the copying machine to the wait-reset state after heating the fusing device for a certain period of time set by the timer.

According to the measure (1) mentioned above, inasmuch as the copying operation is available only after the fusing device reaches a preset temperature for fusing, a defective fusing can be precluded without fail. But it will take a long time for restoring the machine from the wait state to the wait-reset state. In other words, the time required to obtain copies after the copying operation is started by an operator will be protracted. Therefore, a greater improvement is desired from a clerical point of view, in which a speediness is seriously demanded.

On the other hand, according to the measure (2) mentioned above, while the setting time can be set relatively freely by the timer, etc., speeding of the copying operation can not be expected much, since setting of time is usually done with a sufficient safety factor considered in design so as not to cause defective copying. Moreover, despite the fact that a long heating time is required immediately after the start, a countermeasure taken so far is not sufficient and occasionally the trouble occurs in producing the defective copies. In order to obtain good fusing immediately after the start without fail, a long heating-up time for the fusing device is inevitably required after the initial starting state, thus the speeding-up of the copying operation may be greatly hindered.

SUMMARY OF THE INVENTION

It is an object of the present invention to accomplish a speedy copying operation, in particular, to reduce the time required to obtain good copies after starting a copying machine for the copying operation by an operator.

It is another object of the present invention to prevent a defective fusing, in particular, to prevent the defective fusing without fail in both of an initial starting state and a state thereafter.

It is a still further object of the present invention to accomplish a speeding-up of the copying operation simultaneously preventing a defective fusing.

The controlling method in accordance with the present invention is in a copying machine comprising a fusing device which, by rotating a heating roller and a press roller in a mutually forcible contact, fuses a toner image on the copying paper passing through the rollers, that the machine is provided with a wait-reset state capable of the copying operation and a wait state incapable of the copying operation by means of the conditions of the fusing device. It sets the machine to the wait-reset state capable of the copying operation by passing a certain fixed period of time after heating the heating roller to a certain setting temperature higher than a setting temperature for fusing in an initial stage of operation, and after passing the above-mentioned initial stage of operation, the machine is kept in the wait-reset state by heating the fusing device to a fusing temperature from a setting temperature lower than the setting temperature for fusing in the wait state, and after passing a fixed period of time which is shorter than a heating-up time by the time necessary for the copying paper to reach the fusing device, restoring the machine to the wait-reset state capable of the copying operation from the wait state for preheating.

BRIEF DESCRIPTION OF THE DRAWINGS

FIGS. 4-1 and 4-2 are flow charts.

BRIEF DESCRIPTION OF THE PREFERRED EMBODIMENTS

Figure 1:
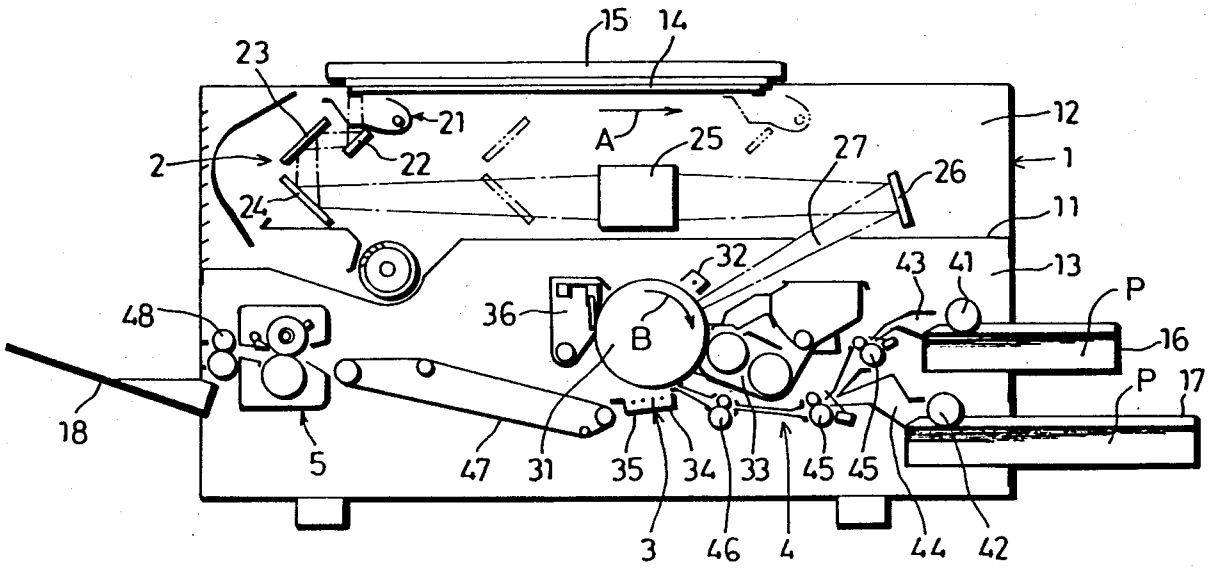
FIG. 1 is a schematic view clearly showing internal structure of a copying machine.

FIG. 1 is a longitudinal sectional view clearly showing internal structure of a copying machine of a type having a movable optical system. The inside of the copying machine body (1) is divided into an upper chamber (12) and the lower chamber (13) by a partition (11), wherein the optical system (2) is provided in the upper chamber (12) and the copy processing section (3) and a conveying section (4) of the copying papers are provided in the lower chamber (13). More particularly, the optical system (2) comprising a light source (21), No. 1 reflector (22), No. 2 reflector (23), No. 3 reflector (24), a lens (25) and No. 4 reflector (26), wherein an original on the contact glass (14) retained closely by an original cover (15) is scanned and exposed and an original image is formed on the surface of a photoreceptor drum (31) to be described later through a slit (27) on the partition (11) by moving the light source (21) and No. 1 through No. 3 reflectors (22) (23) and (24) in a direction shown by an arrow A, [however, a moving speed of No. 2 and No. 3 reflectors (23) (24) is set at half of the moving speed of the light source (21) and the No. 1 reflector (22)].

The copy processing section (3) is provided with an corona charger (32), a developing means (33), a transfer charger (34), a separation charger (35) and a cleaner

(36) arranged in that order in the peripheral of the photoreceptor drum (31), which rotates on every copying operation in a direction shown by an arrow B, wherein an electrostatic latent image corresponding to the original image is formed by the optical system (2) mentioned above after the surface of the photoreceptor drum (31) being uniformly charged by the corona charger (32) with the rotation of the photoreceptor drum (31), the electrostatic latent image is developed into a toner image by the developing means (33), the toner image is transferred onto the copying paper (P) by the transfer charger (34), the copying paper (P) is separated from the photoreceptor drum (31) by the separation charger (35) and the toner remained on the photoreceptor drum (31) is recovered by the cleaner (36).

The conveying section (4) for the copying paper comprises the feed rollers (41) (42), the paper feeding paths (43) (44), a resist roller (45), a conveying roller (46), a conveying belt (47), a fusing device (5) and a delivery roller (48) arranged in that order, wherein by selectively driving each of the feed rollers (41) and (42), the copying papers (P) are taken out one by one from the upper or the lower paper cassettes and directed toward the copy processing section (3) where the toner image is transferred thereon and delivered on the tray (18) after the toner image being heated and fused by the fusing device (5).

Figure 2:
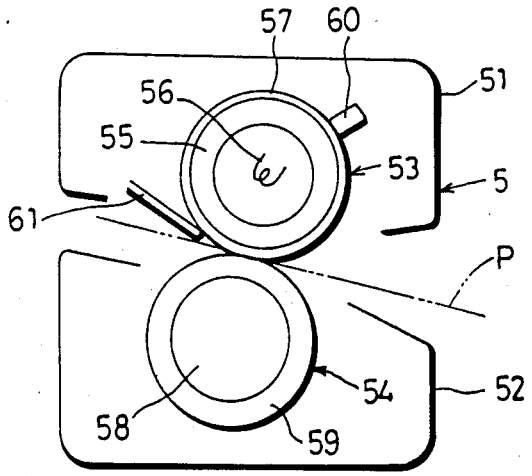
FIG. 2 is an enlarged longitudinal sectional view of a fusing device.

As shown in FIG. 2, the fusing device (5) mentioned above includes a heating roller (53) and a press roller (54) mounted rotatably to the upper and lower frames (51) (52) facing in opposition to each other vertically. In more detail, the heating roller (53) comprises a cylindrical body (55) formed by the material such as aluminum and the like having a high heat conductivity and provided with a heating source (56) such as a heater, etc., therein, and a teflon coated layer (57) on the outer surface thereof, while the press roller (54) comprises a cylindrical body (58) formed by the metal and the like of which outer surface is provided with a silicone rubber layer (59), and by rotating at least one of two rollers by a driving means (not shown) the other roller follows the rotation reversely. Further, a temperature sensor (60) such as a thermistor, etc. is provided in a contacting or adjacent state to the outer surface of the heating roller (53) together with a separating claw (61) for preventing the copying paper (P) from being rolled into the heating roller (53).

Figure 3:
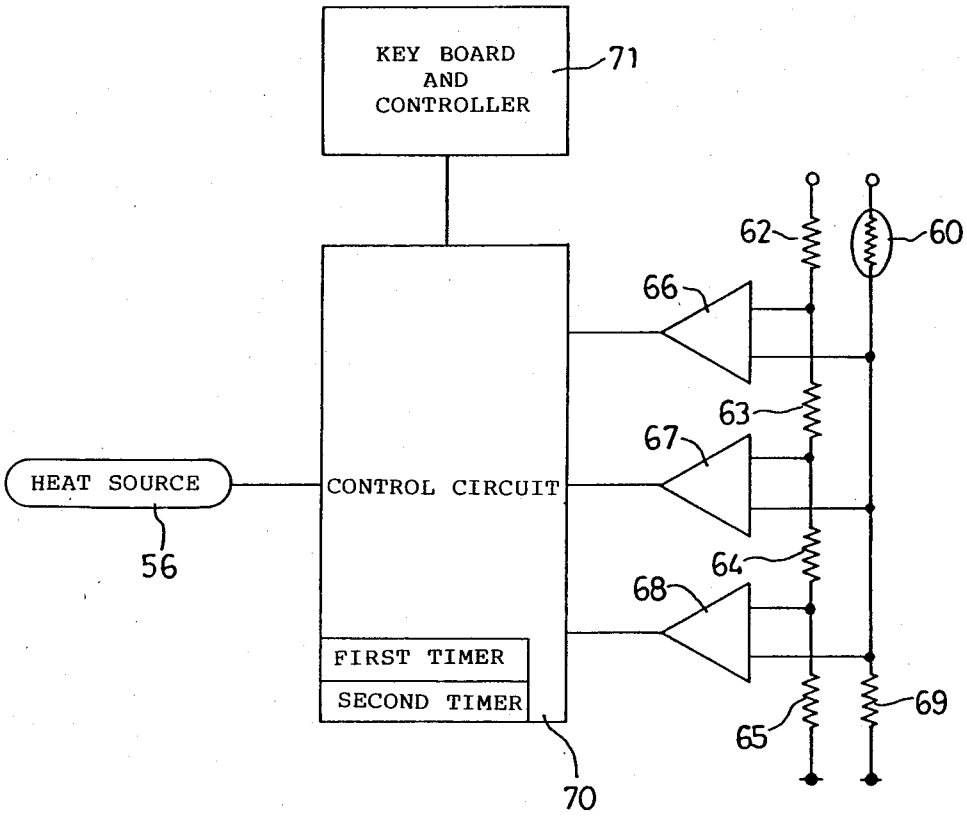
FIG. 3 is an electric circuit diagram.

FIG. 3 shows an electric circuit diagram, which is adapted to control a key board and a controller (71) and the heat source (56) by the output signal from a control circuit (70) by connecting the resistors (62) (63) (64) and (65) in series, providing reference voltages different with each other to the comparators (66) (67) and (68) by the node voltage of each resistor, providing a same comparison voltage to the comparators (66) (67) and (68) by the node voltage of the temperature sensor (60) and the resistor (69) and impressing the output signals from each comparator (66) (67) and (68) to the control circuit (70). The control circuit (70) mentioned above includes a first timer for setting the time at the initial starting stage and a second timer for setting the time after the preheating.

Accordingly, comparators (66), (67) and (68) impress the output signals to control circuit (70) depending upon different temperatures that are detected. Keyboard and controller (71) and heat source (56) may be controlled in accordance with these signals.

Figures 1, 4:
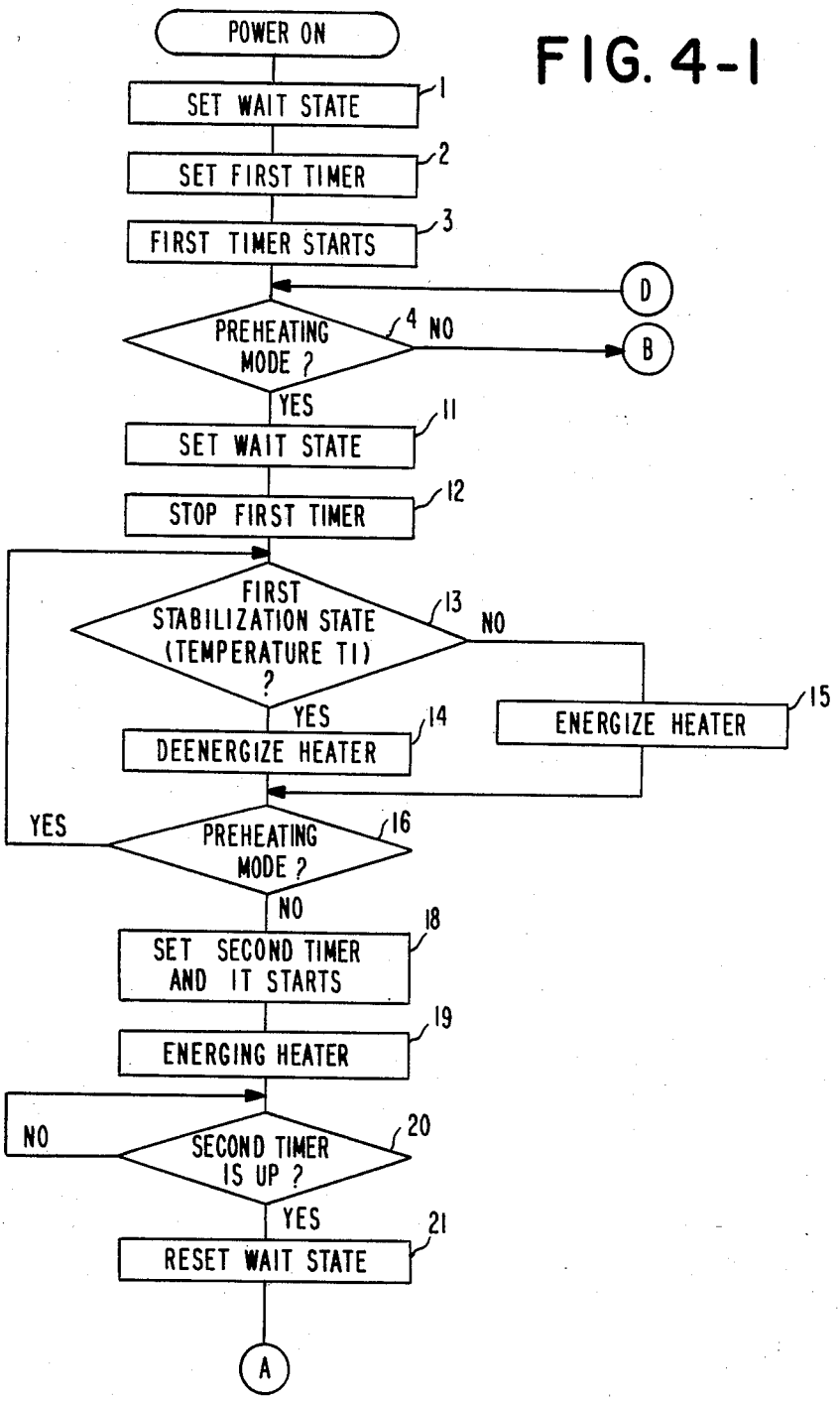
Figures 2, 4:
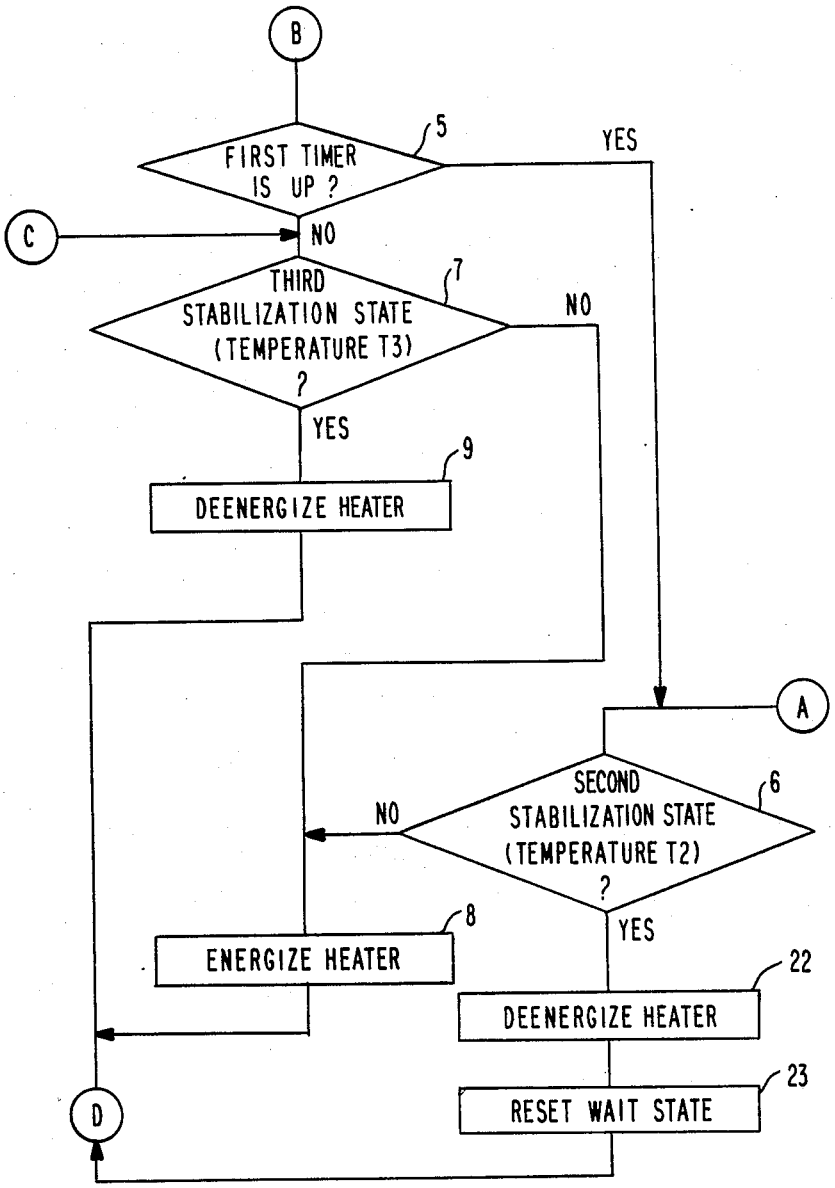

The method for controlling the copying machine described above will be explained with reference to a flow chart in FIG. 4.

When a power switch (not shown) is turned on, the copying machine is set in a wait state (incapable of the copying operation) in step (1). The first timer for setting the time at the initial starting stage is set at time $T_2$ [Ref. to FIG. 5] in step (2), and a timing operation is started in step (3). At step (4), a determination is made as to whether the copying machine is in the preheat mode or in the initial starting stages prior to the preheat mode. Since the copier is in the initial starting stage, the decision is "NO" and the copying machine proceeds to step (5) where a determination is made as to whether the first timer has timed out. If not, a determination is made as to whether the fusing device has reached temperature $T_3$. If the fusing device has not reached temperature $T_3$, the heater is energized at step (8) and steps (4)-(8) are thus repeated until the fusing device has reached temperature $T_3$.

Once the fusing device has reached temperature $T_3$, the heater is deenergized at step (9). There will be thus repetition of steps (4), (5), (7) and (9) until the first timer times out—unless the fusing device falls to a temperature lower than $T_3$, in which case the decision is "NO" at step (7) and the heater is re-energized at step (8). Then again steps (4), (5), (7) and (9) will be executed until either the first timer is up or the fusing device temperature again drops below $T_3$.

When the first timer times out, the copying machine is advanced to step (6) rather than repeating step (7). Step (6) is simply a decision step to determine whether the fusing device has cooled to temperature $T_2$ from $T_3$. If so, the decision is "YES" at step (6), and the copying machine is maintained in the reset-wait state while repeating steps (22), (23), (4), (5) and (6). Should the fusing device temperature fall below temperature $T_2$ during the latter sequence, the decision at step (6) is "NO" and the heater is re-energized at step (8). Thus, the copying machine will be made to execute steps (4), (5), (6) and (8) until the fusing device temperature again reaches $T_2$, in which case steps (4), (5), (6), (22) and (23) will again be executed and so on.

With further reference to step (4), when the reset-wait state has continued for a given period or some predetermined period has transpired after the completion of a last copying operation, a decision is made at step (4) to place the copying machine in the preheating mode. Thus, the decision at step (4) is "YES" whereafter the copying machine is set in the wait state to step (11). Operation of the first timer is halted at step (12). The fusing device is then permitted to cool to, and maintained at temperature $T_1$ at steps (13)-(16). Specifically, a decision is made as to whether the fusing device has reached temperature $T_1$ at step (13). If so, the heater is deenergized (or maintained in a deenergized state) at step (14) or if not, the heater is energized at step (15). At step (16), the decision is made as to whether the copying machine is still to be maintained in the preheating mode.

While the copying machine is executing steps (13)-(16), if a copying operation is requested, for example, by the pressing of a key by an operator, the second timer is set to $ts_2=(t_6-t_4)-(t_6-t_5)=t_5-t_4$ and begins to count down according to step (18). The heater is energized at step (19) in order to heat the fusing device from temperature $T_1$ to $T_2$. At step (20), the fusing device temperature is ascertained. The heater remains energized by repeating step (20) until temperature $T_2$ is attained whereafter the copying machine is returned to the reset-wait state.

Figure 5:
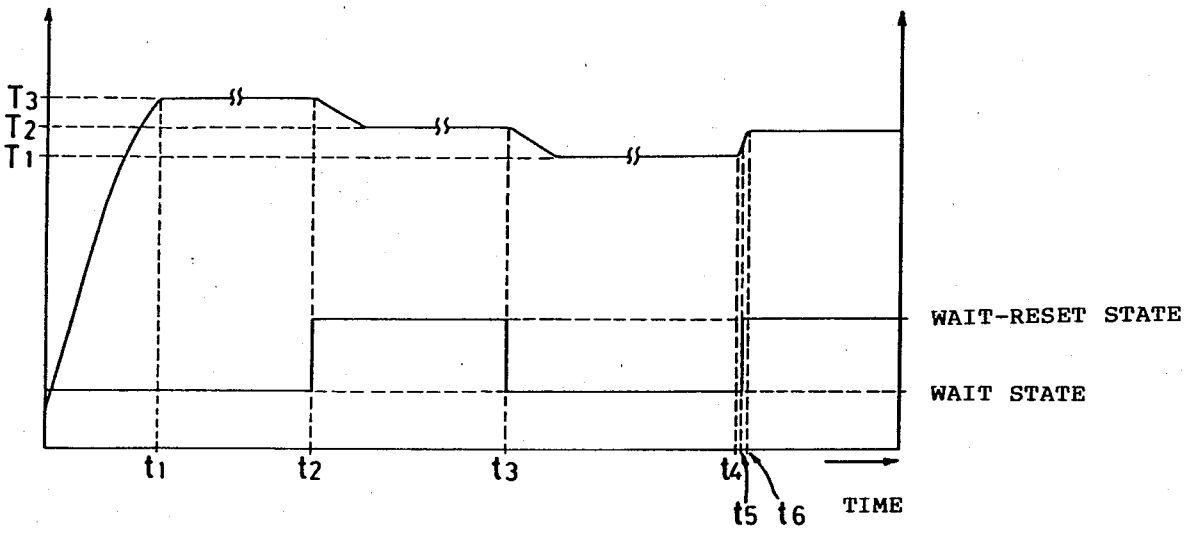
FIG. 5 is a time chart showing temperature variations of a fusing device, a wait state and a wait-reset state of said copying machine.

With reference to FIG. 5 also, $t_6$–$t_4$ represents the time necessary to heat the fusing device from temperature $T_1$ to $T_2$. The time $t_6-t_5$ is the time required for a forward edge of copying paper (P) to reach fusing device 5 during a copying operation. Thus, after the second timer has timed out at $ts_2=t_5-t_4$, the copying machine may now be placed in the reset-wait state since by the time the copying paper (P) reaches the fusing device, an additional time $t_6-t_5$ will have passed so that fusing device (8) will have reached the proper temperature $T_2$ for completing the copy operation. Thereafter, the fusing device temperature is again ascertained at step (6) and so on as described.

FIG. 5 shows the temperature variations of the fusing device (5) in the above operations and the variations of states between the wait state and the wait-reset state of the copying machine proper, wherein the surface temperature of the heating roller (53) rises rapidly by energizing the heater at the initial starting stage and after reaching the setting temperature T3 (e.g. 195° C.) higher than the setting temperature T2 for fusion, it retains the setting temperature T3 mentioned above till the time ts1 set by the first timer has past and heats the press roller (54) and so on rapidly toward the setting temperature T2. During this period, since the fusing device (5) is not heated sufficiently on the whole, the copying machine is retained in the wait state.

After the setting time ts1 mentioned above has past, first, the heater is deenergized and cooled to the setting temperature T2 (e.g. 185° C.) for fusing and retained at the setting temperature T2 thereafter. During this period, since the fusing device (5) is in the state sufficiently heated on the whole, the copying machine is in the wait-reset state, so the copying operation can be performed by operating a print key. On the other hand, when the wait-reset state has continued for a fixed period of time or a fixed period of time has past after the completion of the copying operation, the fusing device (5) is cooled down to the setting temperature T1 for preheating lower than the setting temperature T2 for fusing and is kept at T1 thereafter and the copying machine is retained in the wait state.

When performing the copying operation thereafter by resetting the wait state, firstly, a key, not shown must be operated to energized the heating source (56), then the fusing device (5) will start rising toward the setting temperature T2 and before reaching thereto the copying machine will be set at the wait-reset state. Accordingly, the copying operation can be performed by operating the print key thereafter, and since the fusing device (5) has surely attained the setting temperature T2 when the copying paper (P) reaches the fusing device (5), the defective copying can be completely avoided.

The present invention, as mentioned above, detects the temperature rise of the fusing device at the initial starting state, sets the fixed period of time in the wait state for preheating and sets the restoring time from the wait state to the wait-reset state at the fixed time shorter than the time necessary to heat the fusing device by the time necessary for the apex of the copying paper to reach the fusing device, therefore, the copying operation can be performed only in the state which insures the stable fusing by the sufficient temperature rise and the restoring time from the wait state for preheating to the wait-reset state capable of the copying operation can be shortened.

Further, the present invention is not limited to the above embodiment, but various changes and modifications in designs may be made within the scope not departing from the spirit thereof, for instance, it may be possible to provide a heat source inside the press roll or split the heat source in plural numbers and operate thereof selectively to the size of the copying paper and so on.

What is claimed is:

1. A method for controlling a copying machine having a copying cycle and provided with a fusing device, wherein the fusing device comprises a rotatable heating roller and a press roller in mutually forcible contact with the heating roller, whereby a toner image on a copying paper is fused at a fusing temperature upon passage through the two rollers, said method comprising:

heating the heating roller to a first temperature above the fusing temperature;

delaying the copying cycle during a first interval of time after the heating roller reaches the first temperature;

permitting the heating roller to cool to a second temperature corresponding to the fusing temperature after the first interval of time;

setting the copying cycle to a wait-reset state wherein the copying cycle can be carried out during the wait-reset state;

permitting the heating roller to cool to a third temperature below the second temperature and setting the copying cycle to a wait state, wherein the copying cycle cannot be carried out during the wait state;

heating the heating roller from the third temperature to the second temperature during a second interval of time; and restoring the copying cycle to the wait-reset state during the second time interval before the heating roller reaches the second temperature;

wherein the copying cycle is restored to the wait-reset state before a leading edge of the copying paper reaches the fusing device, and further wherein the fusing device is at the second temperature when the leading edge passes between the rollers.

2. A method for controlling a copying machine according to claim 1, wherein heating the heating roller is carried out by operating a key on an operation panel.

* * * * *